US008591831B2

(12) United States Patent
Park et al.

(10) Patent No.: US 8,591,831 B2
(45) Date of Patent: Nov. 26, 2013

(54) CHIP FOR ANALYZING FLUIDS

(75) Inventors: Jun Ha Park, Seoul (KR); Chan Il Chung, Seoul (KR); Jun Keun Chang, Seoul (KR)

(73) Assignee: NanoEnTek, Inc., Seoul (KR)

( * ) Notice: Subject to any disclaimer, the term of this patent is extended or adjusted under 35 U.S.C. 154(b) by 523 days.

(21) Appl. No.: 12/667,371

(22) PCT Filed: Jul. 23, 2008

(86) PCT No.: PCT/KR2008/004314

§ 371 (c)(1),
(2), (4) Date: Nov. 1, 2010

(87) PCT Pub. No.: WO2009/014379

PCT Pub. Date: Jan. 29, 2009

(65) Prior Publication Data

US 2011/0030458 A1 Feb. 10, 2011

(30) Foreign Application Priority Data

Jul. 23, 2007 (KR) ..... 10-2007-0073659

(51) Int. Cl.
*B01L 99/00* (2010.01)

(52) U.S. Cl.
USPC ..... 422/503; 422/507

(58) Field of Classification Search
USPC ..... 422/502–504, 507
See application file for complete search history.

(56) References Cited

U.S. PATENT DOCUMENTS 7,169,353 B1 * 1/2007 Colin et al. ..... 422/412
2006/0246533 A1 * 11/2006 Fathollahi et al. ..... 435/23

FOREIGN PATENT DOCUMENTS

JP 03-223674 10/1991
JP 2002-538482 11/2002
WO 2005/062059 A1 7/2005
WO 2007/040313 A1 4/2007

OTHER PUBLICATIONS

Japanese Office Action and English-language translation for Japanese Patent Application No. 2010-514650.
International Search Report from PCT/KR2008/004314, Mailing Date of Dec. 30, 2008.

* cited by examiner

*Primary Examiner* — Paul Hyun
(74) *Attorney, Agent, or Firm* — Edwards Wildman Palmer LLP; Steven M. Jensen

(57) ABSTRACT

A fluid analysis chip includes a channel formed within the chip. The chip includes a sample inlet and a sample outlet communicating with an outside of the chip, where the sample inlet and the sample outlet communicate with each other through the closed channel. An expanding part of the channel is formed in a longitudinal direction of the channel in such a manner that a pair of inner walls of the channel define an inner surface of the expanding part, and the expanding part has a larger sectional area than the channel.

6 Claims, 4 Drawing Sheets

CHIP FOR ANALYZING FLUIDS

CROSS-REFERENCES TO RELATED APPLICATIONS

This application is a U.S. national phase application, pursuant to 35 U.S.C. §371 of PCT/KR2008/004314, filed Jul. 23, 2008, designating the United States, which claims priority to Korean Application No. 10-2007-0073659, filed Jul. 23, 2007. The entire contents of the aforementioned patent applications are incorporated herein by this reference.

TECHNICAL FIELD

The present invention relates to a chip having a microchannel, through which fluids moves, and more particularly to a chip for analyzing sample fluids, which includes a sample inlet and a sample outlet, and has a structure where the sample inlet and the sample outlet communicate with each other through a closed channel with a pipe shape.

BACKGROUND ART

In general, biological, chemical, and/or optical analysis of sample fluids is used in analyzing blood clinically collected from a patient and diagnosing diseases, as well as a chemical field and a biotechnology field. Various kinds of chip structures have been developed and used so as to provide an analyzing and/or diagnosing apparatus, which has a further smaller size, and performs analysis of sample fluid in more effective manner. As such, the object of development of a lab-on-a-chip is to make it possible for various functions to be performed in one chip so as to increase effectiveness in analysis and/or diagnosis of diseases, and to make it possible to manufacture a rapid kit.

A lab-on-a-chip means implementing various test processes, which are performed in a laboratory, for example, the separation, refinement, mixing, labeling, analysis, and washing, etc. of a sample, on a chip having a small size. Techniques related to microfluidics and a micro-LHS are typically used in designing the lab-on-a-chip. Also, in manufacturing a chip-structure implementing microfluidics and the micro-LHS, a chip, in which a microchannel is formed at the interior of the chip by using a semiconductor circuit designing technique, has been put on the market.

In general, detecting and analyzing analytes in a very small amount, which are included in sample fluid, such as blood, a body fluid, urine, etc., includes analyzing if a sample fluid reacts against proteins, such as antigens, antibodies, etc. or other material, which have been previously immobilized on a chip, while moving through a channel having a pipe-shaped structure formed in the interior of the chip, through detection of fluorescent material, etc. Therefore, a technique for observing movement of fluids moving in a chip having a channel through the channel and a technique for manufacturing a channel structure are the most important core techniques in manufacturing a small-sized chip for performing fluid analysis and obtaining accurate analysis result by using such a chip.

In a chip (or structure) having a microchannel implementing microfluidics, in order to allow fluids to flow through an inner space formed by a microchannel, a small-size motor is used, or a method for limiting the width and height of a channel so as to allow fluids to move through a microchannel due to capillary phenomenon is used. At this time, in a chip where main driving force causing movement of fluids is capillary force, the result of investigation shows that fact that fluids flowing in a space formed by a channel have an irregular and nonuniform movement pattern. It is understood that such a phenomenon occurs because acting force due to relative action between upper and lower inner walls of a channel and fluids is different from acting force due to relative action between left and lower inner walls of the channel and fluids. As a result, such a nonuniform movement pattern of fluids has been a big obstacle to detection and analysis of analytes in a very small amount in the fluids.

Meanwhile, a chip, which has a sample inlet and a sample outlet included at both ends thereof and has a structure where fluids injected into the sample inlet is discharged through the sample outlet through a closed channel shaped similar to a pipe, is manufactured in such a manner that upper and lower substrates are manufactured and are assembled with each other. However, in order to manufacture a microchannel structure having a size below several tens of micrometers, it is difficult to process edge parts of a channel without loss of other part thereof, and it is also difficult to control standards and quality of a product in mass production. Also, the fine difference of such a channel structure obstructs uniform flux of fluids so that it causes a sample analysis result without consistency in a chip used in detecting analytes in an extremely small amount from a small amount of a sample.

For example, a chip shown in FIGS. 1 and 2 is one example of a conventional chip. The chip includes a body 10 formed in such a manner that a first substrate 11 and a second substrate 12 are assembled with each other. A channel recess 13*b* having a predetermined width and depth is formed at the first substrate 11. In order to form a space to be filled with a sample, the channel recess 13*b* is formed at the first substrate 11 in such a manner that it extends in a longitudinal direction of the substrate while having a predetermined width and a predetermined depth. Therefore, when the first substrate 11 and the second substrate 12 are assembled with each other, the channel 13 has an airtight space. Also, a sample inlet 14, which extends to the outside of the channel so as to allow a sample to be injected into the channel 13, is formed at one end of the channel 13, and a sample outlet 15, which extends to the outside of the channel so as to allow the sample to be discharged, is formed at the other end of the channel. When sample fluid to be analyzed is injected into the channel 13, the injected sample fluid moves along the channel 13 toward the sample outlet 15. As shown in FIG. 3, when the sample fluid forms a pattern while moving, a difference of relative actions between the fluid, which passes though the channel, and upper, lower, left, and right inner walls 13*a* of the channel can cause a difference of capillary force, which is main driving force of movement of fluid in the microchannel. As a result, irregular pattern where a pattern is firstly formed along the left and right inner walls 13*a* is generated. Accordingly, many bubbles are generated in the fluid, thereby causing many problems in analyzing the sample fluid.

In a chip having a channel, which has a space for allowing fluids to flow and also has a sample inlet formed at one side of the channel and a sample outlet formed at the other side thereof, the inventors manufactured a chip having an expanding part, which has a sectional area larger than sectional areas of the left and right inner walls of the channel, formed at entire or a part of each left and right inner wall, and analyzed a pattern of movement of fluids. As a result, the inventors confirmed that the shape of movement of the fluids passing through the channel has a very regular and uniform pattern in the chip according to the present invention so that they completed the present invention.

DISCLOSURE OF INVENTION

Technical Problem

Therefore, the present invention has been made in view of the above-mentioned problems, and it is an object of the present invention to provide a fluid analysis chip, which includes a sample inlet and a sample outlet which extend to outside of the chip and has a structure where the sample inlet and the sample outlet communicate with each other through a closed channel shaped like a pipe, wherein fluid flows through the channel moves while having a regular and uniform pattern.

Also, the present invention provides a method for manufacturing a fluid analysis chip.

Also, the present invention provides a sample fluid analysis method using the fluid analysis chip.

Technical Solution

According to an aspect of the present invention, there is provided a In accordance with an aspect of the present invention, there is provided a chip including a sample inlet and a sample outlet communicating with the outside of the chip, this chip having a structure where the sample inlet and the sample outlet communicate with each other through a closed channel, wherein an expanding part is formed in a longitudinal direction of the channel in such a manner that a pair of inner walls corresponding to each other has a larger sectional area at a part or the whole thereof, so that fluid, which passes through the channel adjacent to the expanding part, moves while making contact with only another pair of inner walls of the channel, which correspond to each other. As such, in the fluid analysis chip according to the present invention, left and right inner walls of the closed channel are substantially expanded so that fluid passing through the channel can move while making contact with only upper and lower inner walls of the channel. As a result, relative action regarding movement of fluid depends on the upper and lower inner walls of the channel so that it is possible to obtain the uniform movement pattern of fluids.

Also, in manufacturing the fluid analysis chip according to the present invention, expanding recesses are formed at each entire part or each part of the left and right inner wall, respectively, in such a manner that they have a sectional area larger than a sectional area of each side inner wall of the channel. Since this doesn't need an accurate process of forming an edge of the channel, the fluid analysis chip is suitable for mass production.

Advantageous Effects

As described above, a fluid analysis chip according to the present invention includes an expanded recess having an inner space, which has an expanded shape, and communicates with a channel. Therefore, a regular movement pattern of fluid passing through the channel is formed so that generation of bubbles is reduced, recurrence is secured, and it is easily performed to detect a signal from analytes in fluids. Also, in implementing a microchannel in a substrate, it is possible to manufacture the channel without concern of loss of each edge of the channel or deformation thereof. Therefore, it is easy to achieve mass production and quality control.

BRIEF DESCRIPTION OF THE DRAWINGS

The foregoing and other objects, features and advantages of the present invention will become more apparent from the following detailed description when taken in conjunction with the accompanying drawings in which.

MODE FOR THE INVENTION

Figure 1:
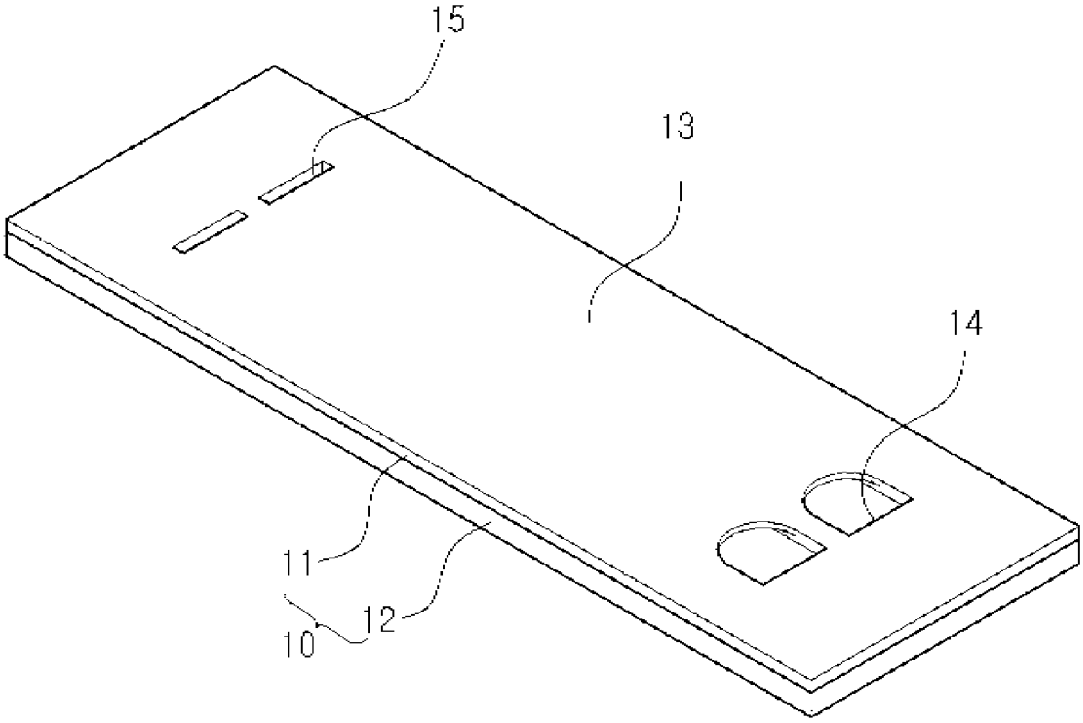
FIG. 1 is a perspective view illustrating a conventional structure of a chip.
Figure 2:
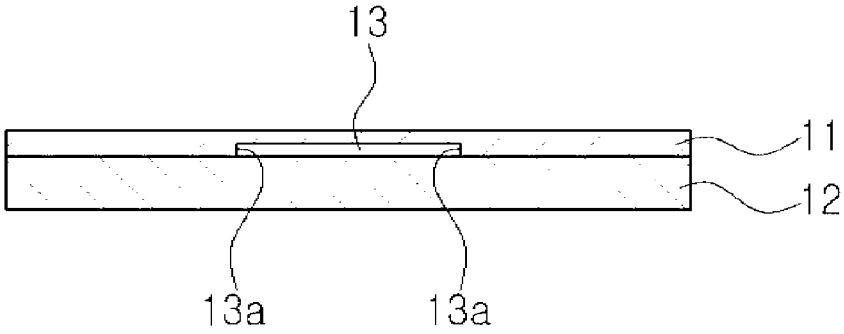
FIG. 2 is a sectional view of the chip shown in FIG. 1.
Figure 3:
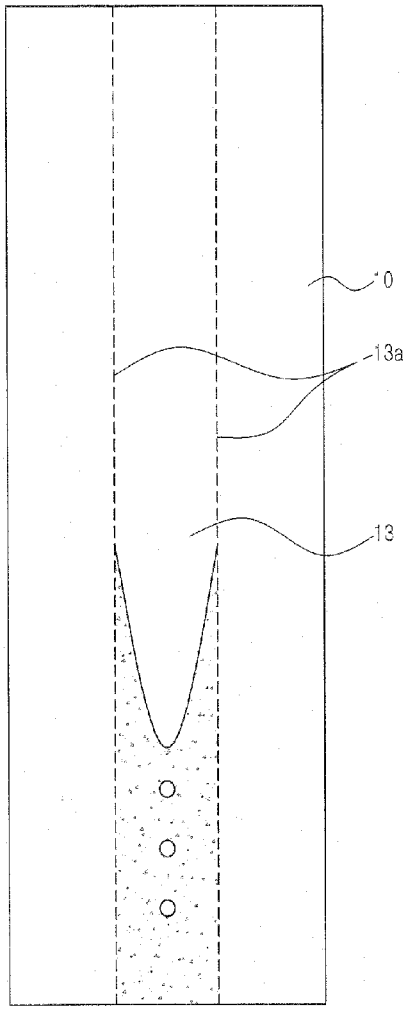
FIG. 3 is a plane view of the chip shown in FIG. 1.

Hereinafter, fluid analysis chips according to embodiments of the present invention will be described in detail with reference to the accompanying drawings. In description of the fluid analysis chips according to the present invention, structures and parts equal to them of a conventional chip designated by the same reference, and are described in detail with reference to FIG. 1.

As a term used in the present invention, a closed channel means a channel which is formed at an interior of a chip so that fluids can flow through the channel without exposure to outside of the chip, and has a shape similar to a pipe.

As a term used in the present invention, a channel inner wall means each surface of a channel, which limits a space allowing fluids flow therein.

Figure 4:
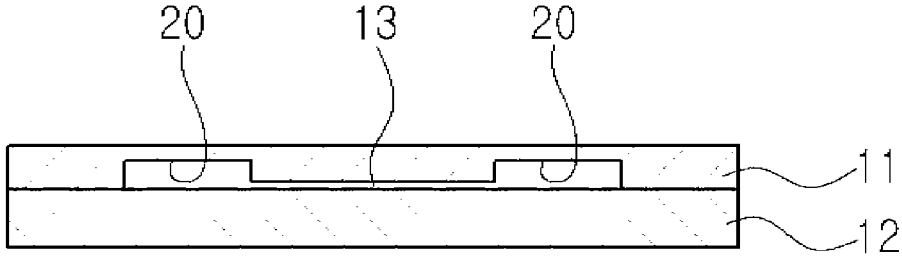
FIG. 4 is a sectional view of a fluid analysis chip according to a first embodiment of the present invention.
Figure 5:
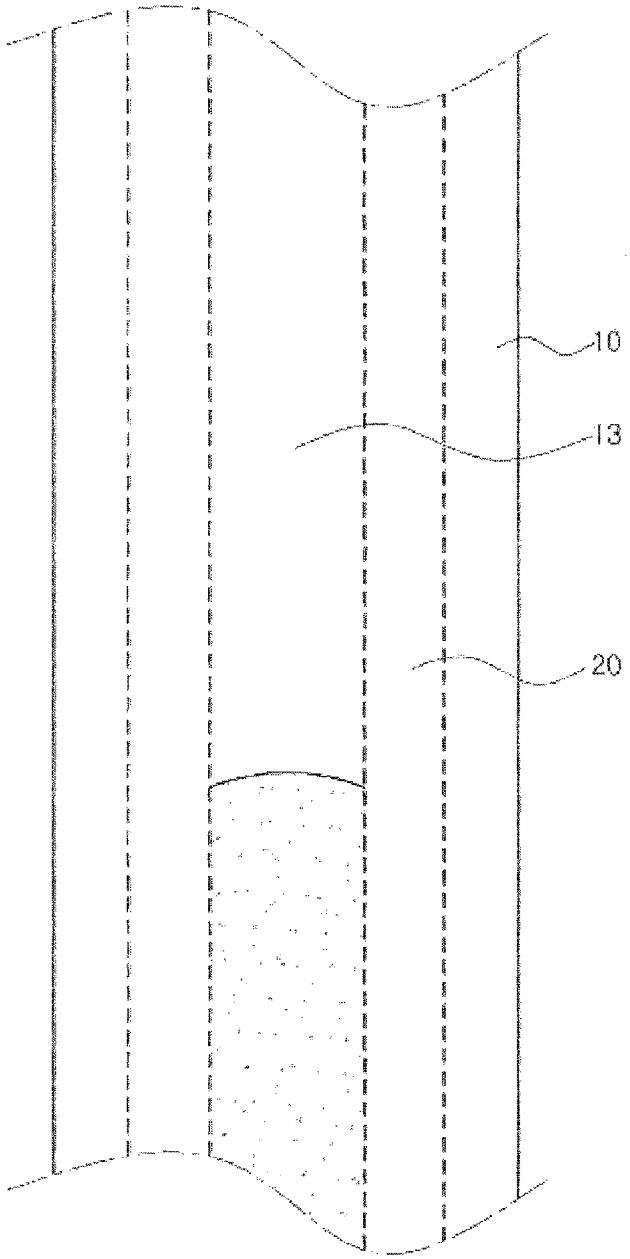
FIG. 5 is a plane view of the fluid analysis chip shown in FIG. 4 according to the present invention, in which a movement pattern of fluids flowing in the chip is shown.

FIG. 4 is a sectional view of a fluid analysis chip according to a first embodiment of the present invention, and FIG. 5 is a plane view of the fluid analysis chip.

As shown, the fluid analysis chip according to the first embodiment of the present invention has a main body 10 formed in such a manner that a first substrate 11 and a second substrate 12 are assembled with each other. A channel recess 13*b* is formed at the first substrate 11 with a predetermined depth and a predetermined length, and extends in a longitudinal direction of the first substrate so as to form a space to be filled with simple fluids. Therefore, the channel 13 has an airtight space when the first substrate 11 and the second substrate 12 are assembled with each other, and a sample inlet 14 and a sample outlet 15 are formed at both ends of the channel 13, respectively.

Also, expanding recesses 20 are formed on the first substrate along left and right inner walls of the channel 13, respectively, while having each depth deeper than a depth of the channel 13, and extend along the left and right inner walls of the channel 13 in a longitudinal direction of the channel. When the first substrate is assembled with the second substrate 12, expanding parts as an expanding space communicating with both sides of a space formed by the channel 13 are formed.

In the fluid analysis chip according to the first embodiment of the present invention, as shown in FIG. 5, when sample fluid including analytes is injected into the channel 13, the injected sample fluid moves toward the outlet 150 along the channel 13 and the expanding recesses 20 while making contact with the upper and lower inner walls of the channel so that a pattern is formed. At this time, relative action between the sample fluid and both side walls of the channel 13 decreases due to the expanding recesses 20 so that a uniform pattern of movement of the sample fluid is formed. Therefore, generation of bubbles decreases, recurrence is secured, and it is easily performed to detect signals from analytes.

Figure 6:
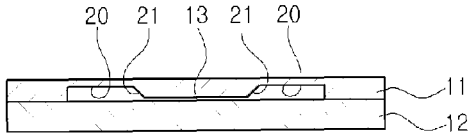
FIG. 6 is a sectional view of a fluid analysis chip according to a second embodiment of the present invention.

The second embodiment of the present invention is shown in FIG. 6. A fluid analysis chip according to the second embodiment includes a main body 10, which is formed in such a manner that a first substrate 11 and a second substrate 12 are assembled with each other. A channel recess 13*b* is formed at the first substrate 11 with a predetermined depth and a predetermined length, and extends in a longitudinal direction of first substrate so as to form a space to be filled with sample fluids. The channel 13 has an airtight space when the first substrate 11 and the second substrate 12 are assembled with each other, and a sample inlet 14 and a sample outlet 15 are formed at both ends of the channel 13, respectively. Also, as shown in FIG. 6, among both inner surfaces of each expanding recess, an inner surface bent toward the channel 13 is a slanting surface 21 having a depth becoming shallower toward the channel 13. The remaining structure and a formed sample pattern are equal to the first embodiment of the present invention.

Figure 7:
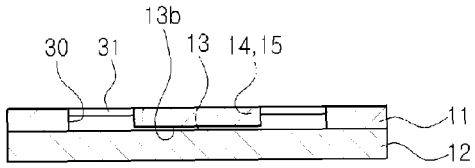
FIG. 7 is a sectional view of a fluid analysis chip according to a third embodiment of the present invention.

FIG. 7 illustrates a third embodiment of the present invention. A fluid analysis chip according to the third embodiment of the present invention includes a main body 10, which is formed in such a manner that a first substrate 11 and a second substrate 12 are assembled with each other. A channel recess 13*b* is formed at the first substrate 11 with a predetermined depth and a predetermined length, and extends in a longitudinal direction of first substrate so as to form a space to be filled with sample fluids. The channel 13 has an airtight space when the first substrate 11 and the second substrate 12 are assembled with each other, and a sample inlet 14 and a sample outlet 15 are formed at both ends of the channel 13, respectively. As shown in FIG. 7, expanding holes 30, which extend through the first substrate 1 along both boundary surfaces of the channel 13, respectively, are formed at the first substrate 1 so as to form an expanding part. Each expanding hole 30 extends along both inner surfaces of the channel 13, and preferably has connecting parts 31 formed with each interval so as to prevent a product from breaking. The remaining structure and formed sample pattern are equal to the first embodiment.

Figure 8:
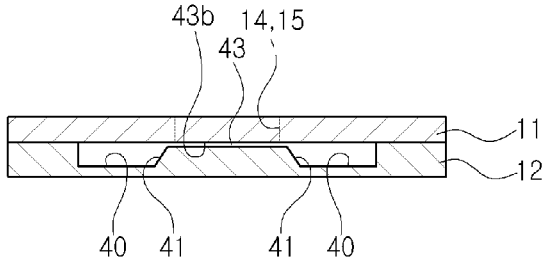
FIG. 8 is a sectional view of a fluid analysis chip according to a fourth embodiment of the present invention.

FIG. 8 illustrates a fourth embodiment of the present invention. A fluid analysis chip according to the fourth embodiment of the present invention includes a main body 10 formed in such a manner that a first substrate 11 and a second substrate 12 are assembled with each other. A channel recess 13*b* is formed at the first substrate 11 with a predetermined depth and a predetermined length and extends in a longitudinal direction of first substrate so as to form a space to be filled with sample fluids. The channel 13 has an airtight space when the first substrate 11 and the second substrate 12 are assembled with each other, and a sample inlet 14 and a sample outlet 15 are formed at both ends of the channel 13, respectively. Also, as shown in FIG. 8, among both inner surfaces of each expanding recess 40, an inner surface bent toward the channel 43 is a slanting surface 41 having a depth shallower toward the channel 43.

As such, the fluid analysis chip according to the present invention includes the expanding recesses 20 and 40, which are spaces expanding along both left and right inner surfaces, and or the expanding holes 30. Therefore, when sample fluid is injected in the channel and moves due to the expanding recesses 20 and 40 the expanding holes 30, relative action between the left and right inner walls of the channel 13 and 43 and the sample fluid disappears or decreases so that the movement pattern of the sample fluid is uniformly formed along surfaces of the channel 13 and 43. Therefore, generation of bubbles in the fluid decreases, recurrence is secured, and it is possible to easily detect signals from analytes in the fluid.

The characteristic of each structure of the expanding recesses 20 and 40 and the expanding hole 30 makes it possible to prevent flatness of the channel 13 and 43 from decreasing due to contraction when the fluid analysis chip according to the present invention is formed by injection.

Moreover, any embodiment of the present invention can be manufactured in such a manner that at least two channel communicate, which sample inlets different from each other and sample outlets different from each other, respectively, are included in one chip. Also, it is possible to manufacture a fluid analysis chip having a structure where one sample inlet and one sample outlet communicate with each other through at least two channels.

The present invention is not limited to the above described embodiment. Those skilled in the art will appreciate that various modifications, additions and substitutions are possible, without departing from the scope and spirit of the invention as disclosed in the accompanying claims.

The invention claimed is:

1. A fluid analysis chip comprising:

a sample inlet and a sample outlet communicating with an outside of the chip;

a channel; and an expanding part formed in a longitudinal direction of the channel in such a manner that a pair of inner walls of the channel define a pair of inner surfaces of the expanding part, and the expanding part has a larger sectional area than a remainder of the channel, wherein the sample inlet and the sample outlet communicate with each other through the channel, and fluid passes through the channel adjacent to the expanding part, and the pair of inner surfaces of the expanding part are slanted such that a depth of the expanding part becomes shallower toward the remainder of the channel.

2. The fluid analysis chip as claimed in claim 1, wherein the channel is formed in such a manner that a first substrate, which has a channel recess extending along a longitudinal direction of the channel while having a predetermined depth and a predetermined width, and a second substrate are assembled with each other, the sample inlet communicating with the channel recess is formed in the first substrate, and the expanding part includes an expanding recess having a depth deeper than a depth of the channel recess of the first substrate.

3. The fluid analysis chip as claimed in claim 1, wherein the channel is formed in such a manner that a first substrate and a second substrate, which has a channel recess extending along a longitudinal direction of the channel while having a predetermined width and a predetermined depth, are assembled with each other, the sample inlet communicating the channel recess is formed in the first substrate, and the expanding part includes an expanding recess having a depth deeper than a depth of the channel recess of the second substrate.

4. The fluid analysis chip as claimed in claim 1, wherein the channel is formed in such a manner that a first substrate, which has a channel recess extending along a longitudinal direction of the channel while having a predetermined depth and a predetermined width, and a second substrate are assembled with each other, the sample inlet communicating with the channel recess is formed in the first substrate, and the expanding part includes expanding holes formed along the channel recess.

5. The fluid analysis chip as claimed in one of claims 1 to 4, further including at least a second channel communicating with a second sample inlet and a second sample outlet.

6. The fluid analysis chip as claimed in one of claims 1 to 4, wherein the sample inlet and the sample outlet communicate with each other through the channel and at least a second channel.

* * * * *